US010234217B2

(12) United States Patent
Shao et al.

(10) Patent No.: US 10,234,217 B2
(45) Date of Patent: Mar. 19, 2019

(54) NONMETAL CORROSION-RESISTANT HEAT EXCHANGE DEVICE AND PLATE-TYPE HEAT EXCHANGER HAVING SAME

(71) Applicant: LUO YANG RUICHANG PETRO-CHEMICAL EQUIPMENT CO., LTD., Henan (CN)

(72) Inventors: Song Shao, Henan (CN); Feng Lv, Henan (CN); Juyuan Tang, Henan (CN); Guohui Shao, Henan (CN)

( * ) Notice: Subject to any disclaimer, the term of this patent is extended or adjusted under 35 U.S.C. 154(b) by 679 days.

(21) Appl. No.: 14/895,482

(22) PCT Filed: Jan. 28, 2014

(86) PCT No.: PCT/CN2014/071638

§ 371 (c)(1),
(2) Date: Dec. 2, 2015

(87) PCT Pub. No.: WO2015/054983

PCT Pub. Date: Apr. 23, 2015

(65) Prior Publication Data

US 2016/0116233 A1 Apr. 28, 2016

(30) Foreign Application Priority Data

Oct. 14, 2013 (CN) ..... 2013 1 0476658

(51) Int. Cl.
*F28F 19/00* (2006.01)
*F28F 19/02* (2006.01)
(Continued)

(52) U.S. Cl.
CPC ..... *F28F 19/02* (2013.01); *F28D 9/0037* (2013.01); *F28D 9/0062* (2013.01);
(Continued)

(58) Field of Classification Search
CPC .. F28F 19/02; F28F 19/00; F28F 21/04; F28F 2230/00; F28F 2240/00; F28F 21/006; F28D 9/0068; F28D 9/0062; F28D 9/0037
See application file for complete search history.

(56) References Cited

U.S. PATENT DOCUMENTS 4,582,126 A * 4/1986 Corey ..... F02F 7/0087 165/82
5,078,208 A * 1/1992 Urch ..... F24F 12/001 165/166
(Continued)

FOREIGN PATENT DOCUMENTS

CN 1993597 A 7/2007
CN 101405559 A 4/2009
(Continued)

OTHER PUBLICATIONS

Abstract of JP2005282907 (A).
(Continued)

*Primary Examiner* — Claire Rojohn, III
(74) *Attorney, Agent, or Firm* — W&K IP(Wayne & King)

(57) ABSTRACT

Provided are a nonmetal corrosion-resistant heat exchange device (20) and a plate-type heat exchanger (100) having same. The heat exchange device (20) comprises a plurality of nonmetal corrosion-resistant heat exchange sheets (21), upper support ribs (22) and lower support ribs (23) installed on top and bottom surfaces of each heat exchange sheet (21), sealing strips (25) disposed at the upper and lower edges at each side of the heat exchange sheets (21), and spacers (26). The adjacent upper support ribs (22) and the lower support ribs (23) located between the adjacent heat exchange sheets (21) together define multiple sealing channels for cold fluid
(Continued)

and hot fluid. The spacers (26) completely seal the upper support ribs (22), the lower support ribs (23) and the sealing strips (25) via a press force.

16 Claims, 8 Drawing Sheets

(51) Int. Cl.
*F28F 21/04* (2006.01)
*F28D 9/00* (2006.01)
*F28F 21/00* (2006.01)

(52) U.S. Cl.
CPC ..... *F28D 9/0068* (2013.01); *F28F 19/00* (2013.01); *F28F 21/006* (2013.01); *F28F 21/04* (2013.01); *F28F 2230/00* (2013.01); *F28F 2240/00* (2013.01)

(56) References Cited

U.S. PATENT DOCUMENTS 5,392,849 A * 2/1995 Matsunaga ..... F28D 9/0075 165/167
6,059,025 A * 5/2000 Hossfeld ..... F28D 9/0068 165/166
6,357,396 B1 * 3/2002 Stansfield ..... F24D 12/02 122/7 R
7,866,379 B2 * 1/2011 Murayama ..... F28D 9/0037 165/166
7,988,447 B2 * 8/2011 Fowser ..... F23L 15/00 126/116 R
8,002,023 B2 * 8/2011 Murayama ..... F28D 9/0037 165/166
8,127,535 B2 * 3/2012 Norsk ..... F01N 3/0231 165/166
9,593,647 B2 * 3/2017 Demots ..... F02M 31/20
9,664,452 B2 * 5/2017 Takada ..... F28F 3/048
2001/0042386 A1 * 11/2001 Allam ..... F25J 3/0409 62/654
2004/0031599 A1 * 2/2004 Wilson ..... F28D 9/0031 165/166
2006/0194159 A1 * 8/2006 Franz ..... F23J 15/04 431/11
2006/0196649 A1 * 9/2006 Shibata ..... F28D 9/0037 165/166
2010/0071887 A1 * 3/2010 Sugiyama ..... F24F 12/006 165/166
2017/0023311 A1 * 1/2017 Urbanski ..... F28F 3/04
2017/0030656 A1 * 2/2017 Lien ..... F28D 20/021

FOREIGN PATENT DOCUMENTS

CN 102003717 A 4/2011
CN 102032587 A 4/2011
CN 103512416 A 1/2014
CN 203534318 U 4/2014
JP 2005282907 A 10/2005

OTHER PUBLICATIONS

Abstract of CN203534318 (U).
Abstract of CN103512416 (A).
Abstract of CN102032587 (A).
Abstract of CN102003717 (A).
Abstract of CN101405559 (A).
Abstract of CN1993597 (A).

* cited by examiner

NONMETAL CORROSION-RESISTANT HEAT EXCHANGE DEVICE AND PLATE-TYPE HEAT EXCHANGER HAVING SAME

BACKGROUND OF THE INVENTION

1. Field of the Invention

The present invention relates to a heat exchange device and a plate-type heat exchanger having same, and more particularly to a high efficiency nonmetal corrosion-resistant heat exchange device and a plate-type heat exchanger having same, which can be used in a condition of strong corrosive mediums.

2. Description of the Prior Art

A plate-type heat exchanger is constructed by many heat exchange sheets, which are pressed together through pads, to be detachable. These heat exchange sheets are generally made of metal. When assembling, two groups of the heat exchange sheets are arranged alternately upper and lower. Sealing strips are fixed between two adjacent heat exchange sheets by adhesive and are used to prevent fluid and gas from being leaked and form narrow flow channels for fluid and gas flowing between the two adjacent heat exchange sheets. The plate-type heat exchanger has advantages of small size, small area, high heat transfer efficiency, smart assembly, small heat loss and convenient removal, cleaning and maintenance.

The prior plate-type heat exchanger has shortcomings of poor corrosion resistance, especially the heat exchange sheets. In particular, if the fluid is a hot sulfuric acid that may be various of concentrations, or a high concentration of chloride solution and so on, the heat exchange sheet is easy to be corroded. Hence, the heat exchange sheet has a short service life, need to be changed frequently, and increases the cost.

BRIEF SUMMARY OF THE INVENTION

In order to overcome the shortcomings of the prior art, the present invention provides a high efficiency nonmetal corrosion-resistant heat exchange device and a plate-type heat exchanger having same, wherein the heat exchange device can be effectively applied to various fluid media except hydrofluoric acid, phosphoric acid and strong alkali, and has the advantages of high heat transfer efficiency, wide application and small pressure drop.

To achieve the aforementioned object of the present invention, the present invention adopts the following technical solution. A high efficiency nonmetal corrosion-resistant heat exchange device comprises multiple nonmetal corrosion-resistant heat exchange sheets, upper support ribs disposed on a top surface of each heat exchange sheet, lower support ribs disposed on a bottom surface of each heat exchange sheet, sealing strips disposed on upper edges of the top surface and lower edges of the bottom surface of each heat exchange sheet, and spacers. The upper support ribs, the lower support ribs and the sealing strips are fixed on the corresponding heat exchange sheet. The spacers are arranged between the lower support ribs of a bottom surface of an odd number heat exchange sheet and the corresponding upper support ribs of a top surface of an even number heat exchange sheet and also arranged between the sealing strips of the bottom surface of the odd number heat exchange sheet and the corresponding sealing strips of the top surface of the even number heat exchange sheet. The adjacent upper and lower support ribs located between the adjacent odd and even number heat exchange sheets together define multiple sealing channels, which can be used as cold fluid channels and hot fluid channels. These sealing channels have different shapes and directions and are not communicated with each other. The spacers are used to completely seal the corresponding upper and lower support ribs and the corresponding sealing strips by a press force.

Further, the connection between the upper and lower support ribs and the heat exchange sheets and between the sealing strips and the heat exchange sheets are realized by means of adhesive or welding for improving the strength and rigidity of the heat exchange sheets.

Further, the structure, arrangement, direction and size of the lower support ribs located on the bottom surface of the odd number heat exchange sheet are completely the same as those of the upper support ribs located on the top surface of the corresponding even number heat exchange sheet.

Further, the highest of the sealing strips and the upper and lower support ribs after being mounted on the heat exchange sheets is the same.

Further, the heat exchange sheet can be a glass plate, which can be made of any glasses having the property of heat transfer and corrosion resistant, such as high boron silicate glasses, aluminum silicate glasses, quartz glasses, glass ceramics, high silica glasses, low alkali boron-free glasses and ceramic glasses.

Further, the heat exchange sheet can be made of ceramics, such as silicon nitride ceramics, high alumina ceramics and silicon carbide ceramics.

Further, the sealing strip is a nonmetal rectangular strip, the material of which may be glasses or ceramics.

Further, the adhesive may be corrosion resistant and high temperature resistant organic adhesive or inorganic adhesive, such as silicone sealant and silicone rubber.

Further, the spacer may be made of non metallic materials, such as PTFE and silicone rubber.

Further, the spacer may be made of metal and nonmetal composite materials, such as flexible graphite composite plate.

Further, each cold fluid channel is constructed from an inlet port to an outlet port and is parallel to the length direction of the corresponding heat exchange sheet; each hot fluid channel is also constructed from an inlet port to an outlet port and is parallel to the width direction of the corresponding heat exchange sheet; and the cold fluid channel and the hot fluid channel are staggered to realize the heat exchange of the cold and hot fluids.

Further, each cold fluid channel is an L shape, and a long side of the cold fluid channel is parallel to the length direction of the heat exchange sheet; each hot fluid channel is an inverted L shape; the inlet port of the cold fluid channel and the inlet port of the hot fluid channel are opposite to each other along the length direction of the heat exchange sheets; the outlet port of the cold fluid channel and the outlet port of the hot fluid channel are respectively located on two end portions of the same sides of the heat exchange sheets or located on two end portions of two sides of the heat exchange sheets; there forms a rectangular outcut, which is corresponding to an upright column of a heat exchanger, on the middle of one side of the heat exchange sheet to separate the hot and cold fluids; the cold and hot fluids can achieve countercurrent heat transfer.

Further, each cold fluid channel is a "2" shape; a long side of the cold fluid channel is parallel to the length direction of the heat exchange sheet; each hot fluid channel is an inverted "2" shape; the inlet port of the cold fluid channel and the outlet port of the hot fluid channel are located two different end portions of the same sides of the heat exchange sheets and the cold and hot fluids achieve countercurrent heat transfer; or the inlet port and the outlet port of the cold fluid channel are disposed along the width direction of the heat exchange sheet, and the cold and hot fluids achieve countercurrent heat transfer.

Further, the cold fluid channel is a "Z" shape; a long side of the cold fluid channel is parallel to the length direction of the heat exchange sheet; the hot fluid channel is an inverted "Z" shape; the inlet port of the cold fluid channel and the outlet port of the hot fluid channel are disposed two end portions of two sides of the heat exchange sheets; and the cold and hot fluids achieve countercurrent heat transfer.

A plate-type heat exchanger with a high efficiency nonmetal corrosion-resistant heat exchange device comprises a frame and the high efficiency nonmetal corrosion-resistant heat exchange device mounted in the frame and described above. The frame includes an upper cover, a bottom plate and an upright column. The high efficiency nonmetal corrosion-resistant heat exchange device is mounted between the upper cover and the bottom plate of the frame.

Further, an internal surface of the frame is anti-corrosion treated by PFA coating, enamel, or lined PTFE.

Because of adopting above technical solution, the present invention has the following beneficial effects:

1. Corrosion resistance to realize a long period of a stable operation:

The heat exchange sheet is made of glass or ceramic. The glass has a strong corrosion resistance. Except hydrofluoric acid, fluoride, thermal phosphoric acid and alkali, the vast majority of inorganic acid, organic acid and organic solvent are not sufficient to cause glass corrosion. So the glass is one of the best materials resisting acid dew point corrosion and it can ensure that the heat exchange sheet realizes a long period of a stable operation in a low temperature flue gas environment.

2. Small pressure drop

The surface of the heat exchange sheet made of glass or ceramic is smooth. The flow resistance of the fluid is small, the surface used to transfer heat is not easy to form fouling thereon, and it is not necessary to be cleaned, thus the pressure drop is small. This will reduce the power consumption of a pump or a fan motor. By means of test and calculation, in the fluid channels of the same length, the pressure drop of a non-welding high-temperature plate-type heat exchanger is only ⅖ to ⅗ of the pressure drop of a tube bundle type. Therefore, the heat exchanger of the present invention can reduce the operation costs.

3. Good heat transfer performance

After experiment, the heat transfer coefficient of the heat exchanger of the present invention is 1.2 to 1.5 times of a tube shell heat exchanger under the same flow rate.

4. High heat transfer coefficient

Because the support ribs can guide the flow path of the medium, the cold and hot fluids on the top surface and the bottom surface of the heat exchange sheet can achieve countercurrent heat transfer and the heat transfer efficiency can be improved significantly.

5. The heat exchange sheet made of glass or ceramic employs the support ribs fixed on two surfaces thereof to efficiently improve strength, rigidity and reliability.

REFERENCE NUMBER LISTS

Figure 1:
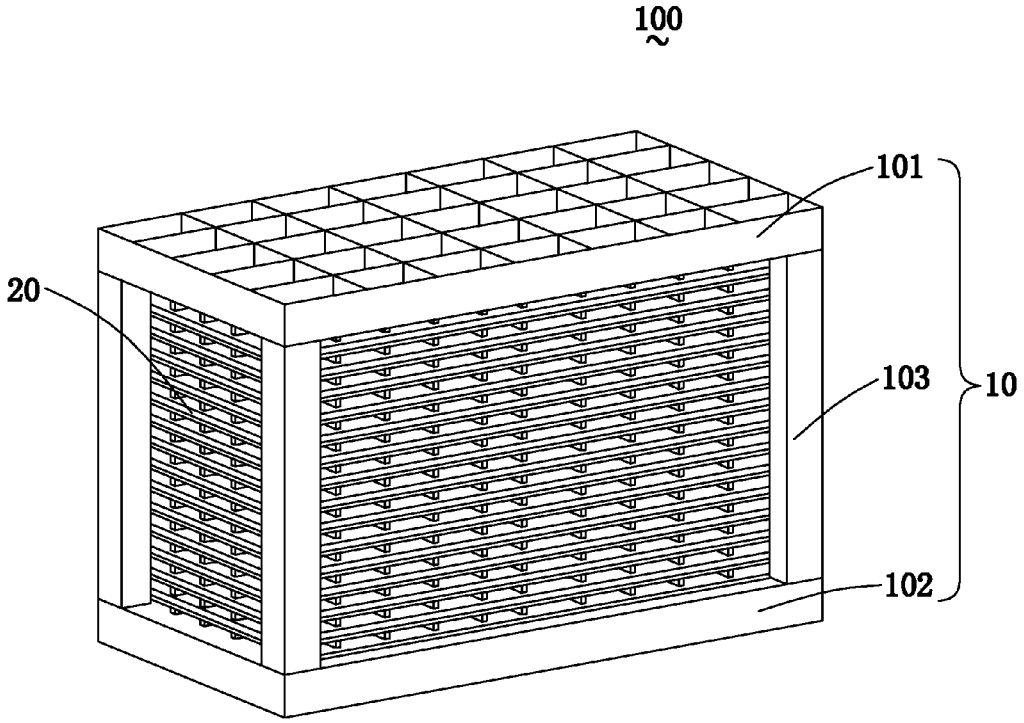
FIG. 1 is a structure schematic view of a plate-type heat exchanger with a high efficiency nonmetal corrosion-resistant heat exchange device of the present invention.

100 Plate-type heat exchanger
10 Frame
101 Upper cover
102 Bottom plate
103 Upright column
20 Heat exchange device
21 Heat exchange sheet
22 Upper support rib
23 Lower support rib
25 Sealing strip
26 Spacer
21' Odd number heat exchange sheet
21" Even number heat exchange sheet
27, 27' Inlet port
28, 28' Outlet port
29 Rectangular outcut
30 Sealing channel
301 Long side
210, 212 Two end portions

DETAILED DESCRIPTION OF THE PREFERRED EMBODIMENTS

The following text will take a preferred embodiment of the present invention with reference to the accompanying drawings for detail description as follows:

Please refer to FIG. 1, which shows a plate-type heat exchanger 100 of the present invention. The plate-type heat exchanger 100 comprises a frame 10 and a high efficiency nonmetal corrosion-resistant heat exchange device 20 mounted in the frame 10. The frame 10 comprises an upper cover 101, a bottom plate 102 and an upright column 103. The heat exchange device 20 is mounted between the upper cover 101 and the bottom plate 102. An internal surface of the frame 10 is anti-corrosion treated by PFA coating, enamel, or lined PTFE, etc.

Figure 2:
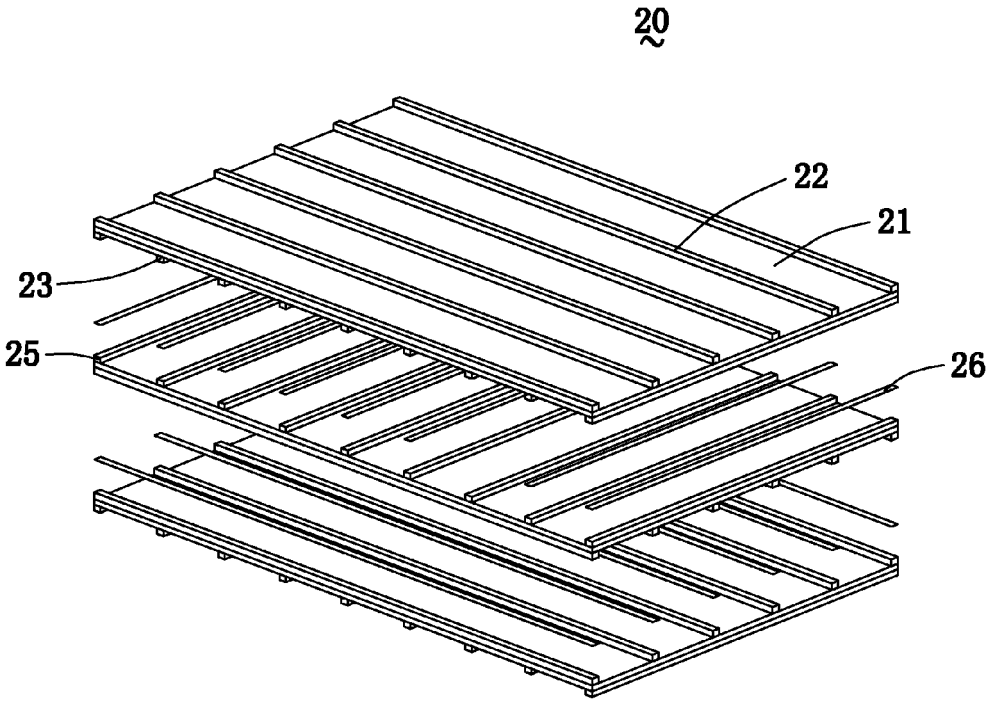
FIG. 2 is a structure schematic view of a first embodiment of the high efficiency nonmetal corrosion-resistant heat exchange device of the present invention.

Please refer to FIG. 2, which is a structure schematic view of a first embodiment of the high efficiency nonmetal corrosion-resistant heat exchange device 20 of the present invention. The heat exchange device 20 includes multiple nonmetal corrosion-resistant rectangular heat exchange sheets 21, upper support ribs 22 mounted on a top surface of each rectangular heat exchange sheet 21, lower support ribs 23 mounted on a bottom surface of each rectangular heat exchange sheet 21, sealing strips 25 mounted on upper edges of the top surface and lower edges of the bottom surface of each rectangular heat exchange sheet 21, and spacers 26. The connections between the upper and lower support ribs 22, 23 and the heat exchange sheets 21 and between the sealing strips 25 and the heat exchange sheets 21 are all realized by means of adhesive or welding. The upper and lower support ribs 22, 23 can be flat round, hexagonal, or other shaped in order to improve heat transfer and strength properties of the heat exchange sheet 21. The shape and arrangement of the upper and lower support ribs 22, 23 can be disposed according to the demand of the media flow and the heat exchanger. Here will take two adjacent heat exchange sheets, which are called an odd number heat exchange sheet 21' and an even number heat exchange sheet 21", as an example to specifically describe the heat exchange device of the present invention. The structure, arrangement, direction and size of the lower support ribs 23 located on a bottom surface of the odd number heat exchange sheet 21' are completely the same as those of the upper support ribs 22 located on a top surface of the even number heat exchange sheet 21". The highest of the sealing strips 25 and the upper and lower support ribs 22, 23 after being mounted on the heat exchange sheets 21', 21" is the same. The spacers 26 are arranged between the lower support ribs 23 of the bottom surface of the odd number heat exchange sheet 21' and the corresponding upper support ribs 22 of the top surface of the even number heat exchange sheet 21" and also arranged between the sealing strips 25 of the bottom surface of the odd number heat exchange sheet 21' and the corresponding sealing strips 25 of the top surface of the even number heat exchange sheet 21".

The heat exchange device 20 consists of multiple odd number heat exchange sheets 21' and multiple even number heat exchange sheets 21", which are stacked alternatively. Each lower support rib 23 of each odd number heat exchange sheet 21' is just completely aligned with one side of the corresponding spacer 26, and each upper support rib 22 of each even number heat exchange sheet 21" is just completely aligned with the other side of the corresponding spacer 26. Similarly, each sealing strip 25 on the bottom surface of each odd number heat exchange sheet 21' is just completely aligned with one side of the corresponding spacer 26, and each sealing strip 25 on the top surface of each even number heat exchange sheet 21" is just completely aligned with the other side of the corresponding spacer 26. The spacers 26 can completely seal the corresponding upper and lower support ribs 22, 23, and also can completely seal the corresponding sealing strips 25 by a certain press force produced by a mechanical or hydraulic device. Now, the adjacent upper and lower support ribs 22, 23 located between the adjacent odd and even number heat exchange sheets 21', 21" define multiple sealing channels 30, which have different shapes and directions and are not communicated with each other. Two end ports 27, 28 of each sealing channel 30 are used to allow fluid and gas to enter into or get out. The sealing channels 30 can be used as cold fluid channels and hot fluid channels. Moreover, the sealing channels 30 located on the top and bottom surfaces of one heat exchange sheet 21 can also allow different temperature fluids to flow therein and can separate the cold fluid and the hot fluid in order to transfer heat. The heat exchange device 20 is placed between the upper cover 101 and the bottom plate 102, thereby constructing the whole heat exchanger. Two adjacent sealing channels 30 located one side of the heat exchange sheet 21 can respectively allow two different media fluids to flow therein, so the two media fluids can exchange heat through the heat exchange sheet 21.

The heat exchange sheet 21 is a rectangular nonmetal plate. The heat exchange sheet 21 may be a glass plate, which can be made of any glasses having the property of heat transfer and corrosion resistant, such as high boron silicate glasses, aluminum silicate glasses, quartz glasses, glass ceramics, high silica glasses, low alkali boron-free glasses, and ceramic glasses, etc.

The heat exchange sheet 21 also can be made of ceramics, such as silicon nitride ceramics, high alumina ceramics, and silicon carbide ceramics, etc.

The sealing strip 25 is a nonmetal rectangular strip, the material of which may be glasses or ceramics.

The adhesive may be corrosion resistant and high temperature resistant organic adhesive or inorganic adhesive, such as silicone sealant, silicone rubber, etc.

The material of the spacer 26 may be non metallic materials, such as PTFE, silicone rubber, and metal and nonmetal composite materials, such as flexible graphite composite plate, etc.

In FIG. 2, each cold fluid channel constructed from an inlet port 27 to an outlet port 28 is parallel to the length direction of the heat exchange sheet 21. Each hot fluid channel constructed from an inlet port 27' to an outlet port 28' is parallel to the width direction of the heat exchange sheet 21. The cold fluid channel and the hot fluid channel are staggered to realize the heat exchange of the cold and hot fluids.

Figure 3:
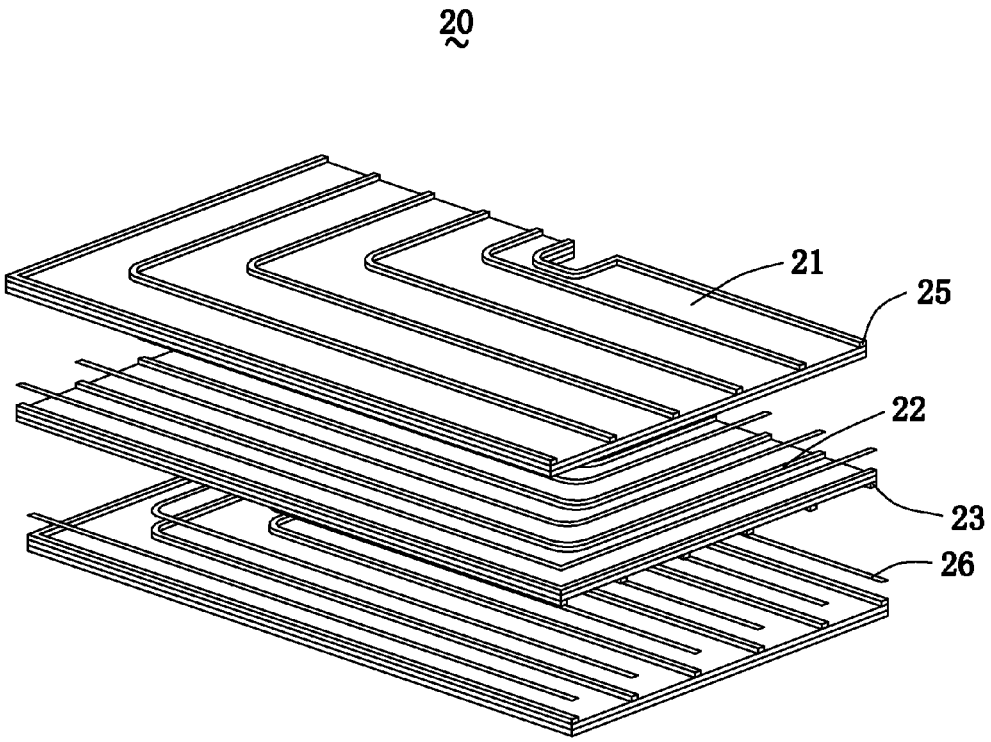
FIG. 3 is a structure schematic view of a second embodiment of the high efficiency nonmetal corrosion-resistant heat exchange device of the present invention.

Please refer to FIG. 3, which is a structure schematic view of a second embodiment of the high efficiency nonmetal corrosion-resistant heat exchange device 20 of the present invention. Each cold fluid channel is an L shape, and a long side 301 of the cold fluid channel is parallel to the length direction of the heat exchange sheet 21. Each hot fluid channel is an inverted L shape. The inlet port 27 of the cold fluid channel and the inlet port 27' of the hot fluid channel are opposite to each other along the length direction of the heat exchange sheets 21. The outlet port 28 of the cold fluid channel and the outlet port 28' of the hot fluid channel are respectively located on two end portions 210, 212 of the same sides of the heat exchange sheets 21. Specifically, the outlet port 28 of the cold fluid channel is located on a front end portion 210 of a right side of the odd number heat exchange sheet 21', and the outlet port 28" of the hot fluid channel is located on a rear end portion 212 of a right side of the even number heat exchange sheet 21". There forms a rectangular outcut 29, which is corresponding to the upright column of the heat exchanger, on the middle of the right side of the heat exchange sheet to separate the hot and cold fluids. In the present invention, the cold and hot fluids can achieve countercurrent heat transfer.

Figure 4:
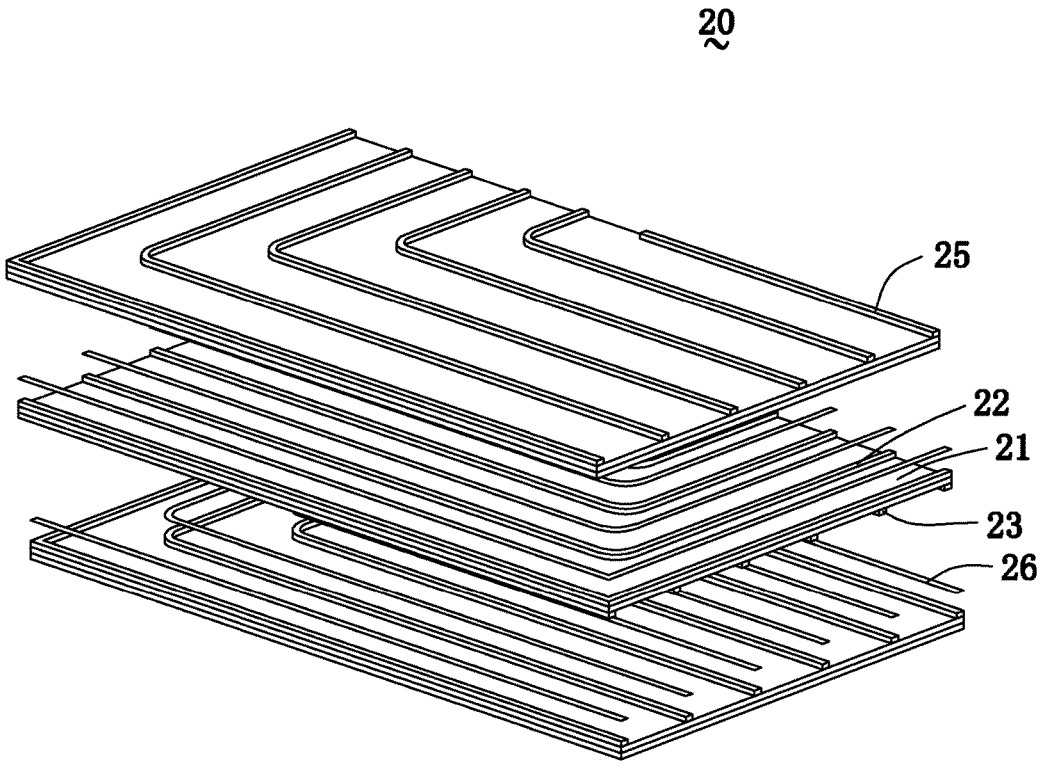
FIG. 4 is a structure schematic view of a third embodiment of the high efficiency nonmetal corrosion-resistant heat exchange device of the present invention.

FIG. 4 is a structure schematic view of a third embodiment of the high efficiency nonmetal corrosion-resistant heat exchange device 20 of the present invention, which is similar to that of FIG. 3. The difference is that: the outlet ports of the cold and hot fluid channels in FIG. 4 are respectively disposed on two end portions of two sides of the heat exchange sheets.

Figure 5:
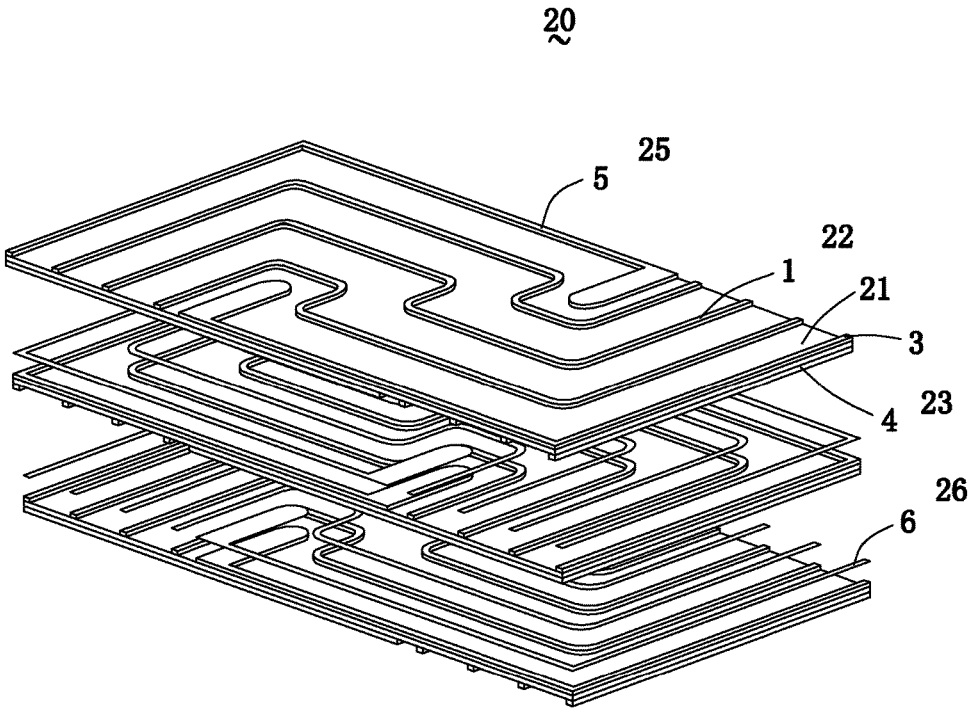
FIG. 5 is a structure schematic view of a forth embodiment of the high efficiency nonmetal corrosion-resistant heat exchange device of the present invention.

FIG. 5 is a structure schematic view of a forth embodiment of the high efficiency nonmetal corrosion-resistant heat exchange device 20 of the present invention. Each cold fluid channel is a "2" shape, and the long side 301 of the cold fluid channel is parallel to the length direction of the heat exchange sheet 21. Each hot fluid channel is an inverted "2" shape. The inlet port 27 of the cold fluid channel and the outlet port 28' of the hot fluid channel are located two different end portions of the same sides of the heat exchange sheets. Hence, the cold and hot fluids can achieve countercurrent heat transfer.

Figure 6:
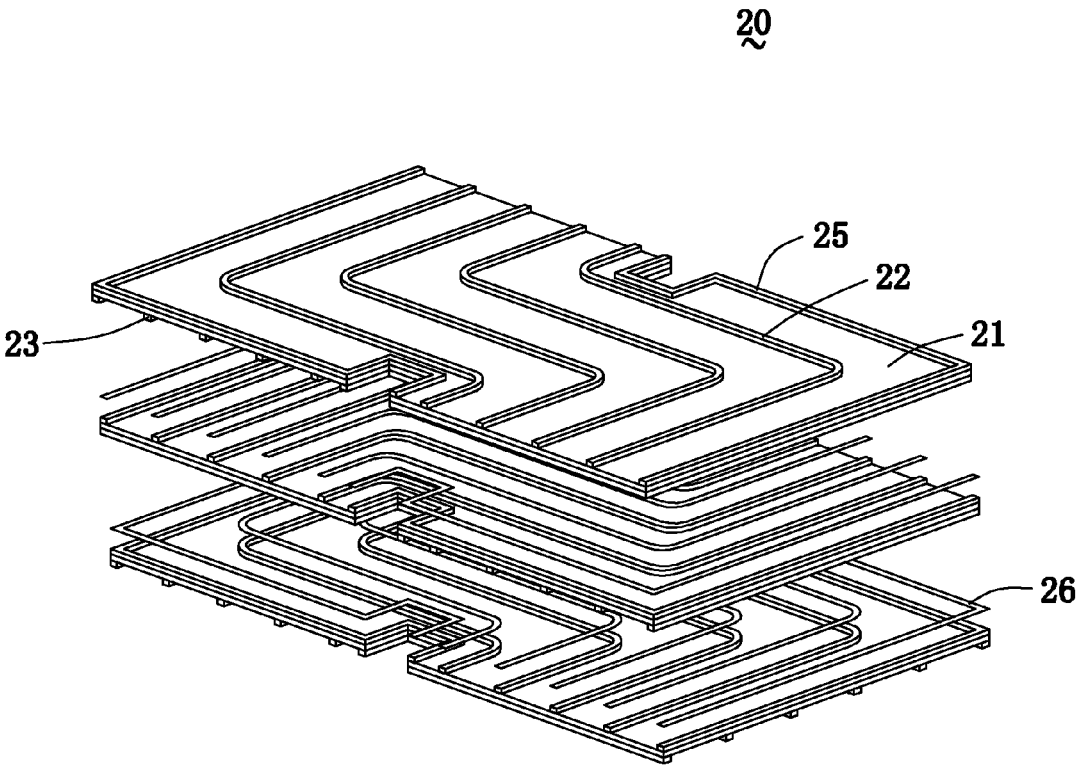
FIG. 6 is a structure schematic view of a fifth embodiment of the high efficiency nonmetal corrosion-resistant heat exchange device of the present invention.

FIG. 6 is a structure schematic view of a fifth embodiment of the high efficiency nonmetal corrosion-resistant heat exchange device 20 of the present invention, which is similar to that in FIG. 5. The inlet port and the outlet port of the cold fluid channel in FIG. 6 are disposed along the width direction of the heat exchange sheet 21.

Figure 7:
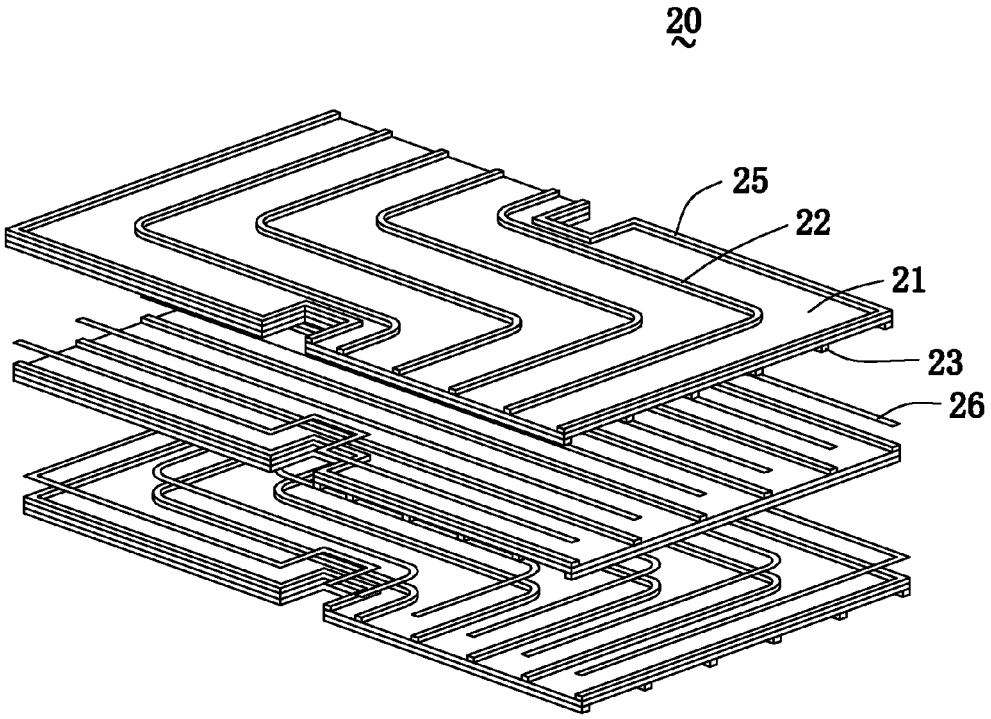
FIG. 7 is a structure schematic view of a sixth embodiment of the high efficiency nonmetal corrosion-resistant heat exchange device of the present invention.

FIG. 7 is a structure schematic view of a sixth embodiment of the high efficiency nonmetal corrosion-resistant heat exchange device 20 of the present invention. The cold fluid channel is a "Z" shape. The long side of the cold fluid channel is parallel to the length direction of the heat exchange sheet 21. The hot fluid channel is an inverted "Z" shape. The inlet port of the cold fluid channel and the outlet port of the hot fluid channel are disposed two end portions of two sides of the heat exchange sheets. Therefore, the cold and hot fluids can achieve countercurrent heat transfer.

Figure 8:
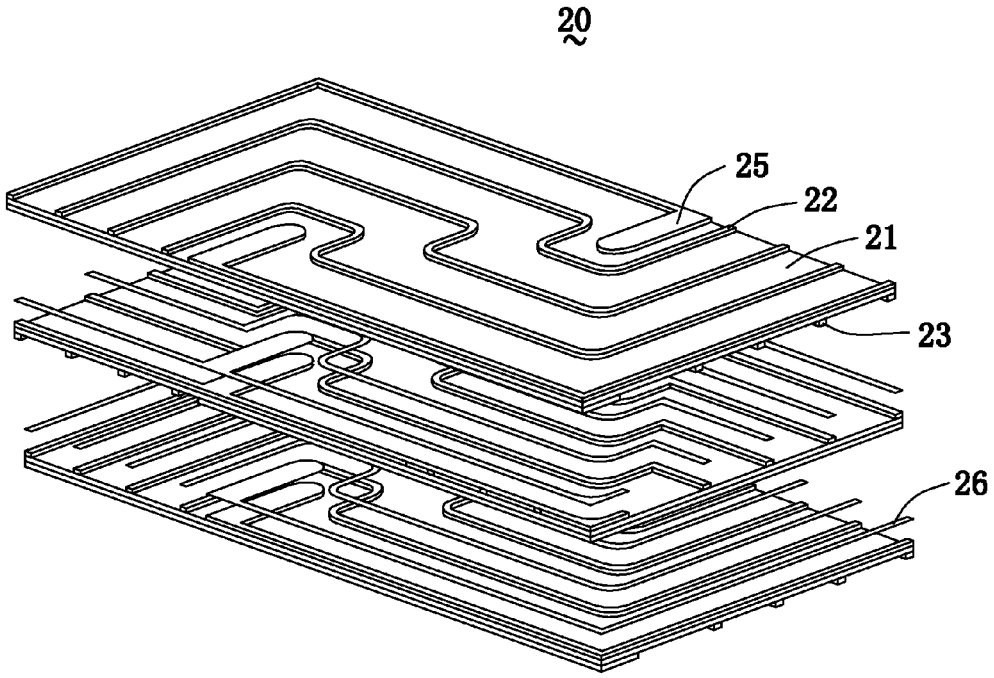
FIG. 8 is a structure schematic view of a seventh embodiment of the high efficiency nonmetal corrosion-resistant heat exchange device of the present invention.

FIG. 8 is one of embodiments of the heat exchange device of the present invention, which is similar to that in FIG. 7. The inlet port and the outlet port of the cold fluid channel are disposed along the width direction of the heat exchange sheet 21 for being countercurrent with the hot fluid.

In another embodiment, there is no spacer between the lower support rib of the odd number heat exchange sheet 21' and the upper support rib of the even number heat exchange sheet 21". The lower support rib of the odd number heat exchange sheet 21' and the upper support rib of the even number heat exchange sheet 21" are directly joined together by means of adhesive or welding. And the sealing strips of the odd number heat exchange sheet 21' and the corresponding sealing strips of the even number heat exchange sheet 21" may also be directly joined together by means of adhesive or welding. The welding mode may be vacuum diffusion welding or brazing.

Moreover, the upper support ribs 22, the lower support ribs 23 and the sealing strips may be directly formed on the heat exchange sheet 21 by means of hot pressing or etching.

We claim:

1. A high efficiency nonmetal corrosion-resistant heat exchange device, comprising multiple nonmetal corrosion-resistant heat exchange sheets, upper support ribs disposed on a top surface of each heat exchange sheet, lower support ribs disposed on a bottom surface of each heat exchange sheet, sealing strips disposed on upper edges of the top surface and lower edges of the bottom surface of each heat exchange sheet, and spacers; wherein the heat exchange sheets consist of multiple odd number heat exchange sheets and multiple even number heat exchange sheets, which are stacked alternatively; the upper support ribs, the lower support ribs and the sealing strips are fixed on the corresponding heat exchange sheet; the spacers are arranged between the lower support ribs of a bottom surface of the odd number heat exchange sheet and the corresponding upper support ribs of a top surface of the even number heat exchange sheet and also arranged between the sealing strips of the bottom surface of the odd number heat exchange sheet and the corresponding sealing strips of the top surface of the even number heat exchange sheet; the adjacent upper and lower support ribs are located between the adjacent odd and even number heat exchange sheets together defining multiple sealing channels, which can be used as cold fluid channels and hot fluid channels; and the sealing channels have different shapes and directions and are not communicated with each other; each pair of support ribs consisting of one lower support rib of the bottom surface of the odd number heat exchange sheet and one corresponding upper support rib of the top surface of the even number heat exchange sheet is provided therebetween with one spacer having a shape identical to that of the pair of support ribs, and each pair of sealing strips consisting of one sealing strip of the bottom surface of the odd number heat exchange sheet and one corresponding sealing strip of the top surface of the even number heat exchange sheet is provided therebetween with one spacer having a shape identical to that of the pair of sealing strips; the spacers are capable of completely sealing the corresponding upper and lower support ribs and the corresponding sealing strips under a press force.

2. The high efficiency nonmetal corrosion-resistant heat exchange device as claimed in claim 1, characterized in that: connections between the upper and lower support ribs and the heat exchange sheets and between the sealing strips and the heat exchange sheets are realized by an adhesive or welding for improving a strength and rigidity of the heat exchange sheets.

3. The high efficiency nonmetal corrosion-resistant heat exchange device as claimed in claim 1, characterized in that: a structure, arrangement, direction and size of the lower support ribs located on the bottom surface of the odd number heat exchange sheet are completely the same as those of the upper support ribs located on the top surface of the corresponding even number heat exchange sheet.

4. The high efficiency nonmetal corrosion-resistant heat exchange device as claimed in claim 3, characterized in that: heights of the sealing strips and the upper and lower support ribs after being mounted on the heat exchange sheets are identical.

5. The high efficiency nonmetal corrosion-resistant heat exchange device as claimed in claim 1, characterized in that: the heat exchange sheet can be a glass plate, which can be made of any glasses having a property of heat transfer and corrosion resistant, including high boron silicate glasses, aluminum silicate glasses, quartz glasses, glass ceramics, high silica glasses, low alkali boron-free glasses and ceramic glasses.

6. The high efficiency nonmetal corrosion-resistant heat exchange device as claimed in of claim 1, characterized in that: the heat exchange sheet can be made of ceramics, including silicon nitride ceramics, high alumina ceramics and silicon carbide ceramics.

7. The high efficiency nonmetal corrosion-resistant heat exchange device as claimed in claim 1, characterized in that: the sealing strip is a nonmetal rectangular strip, a material of which may be glasses or ceramics.

8. The high efficiency nonmetal corrosion-resistant heat exchange device as claimed in claim 2, characterized in that: the adhesive may be corrosion resistant and high temperature resistant organic adhesive or inorganic adhesive, including silicone sealant and silicone rubber.

9. The high efficiency nonmetal corrosion-resistant heat exchange device as claimed in claim 1, characterized in that: the spacer may be made of non metallic materials, including PTFE and silicone rubber.

10. The high efficiency nonmetal corrosion-resistant heat exchange device as claimed in claim 1, characterized in that: the spacer may be made of metal and nonmetal composite materials, including flexible graphite composite plate.

11. The high efficiency nonmetal corrosion-resistant heat exchange device as claimed in claim 1, characterized in that: each cold fluid channel is constructed from an inlet port to an outlet port and is parallel to a length direction of the corresponding heat exchange sheet; each hot fluid channel is also constructed from an inlet port to an outlet port and is parallel to a width direction of the corresponding heat exchange sheet; and the cold fluid channel and the hot fluid channel are staggered.

12. The high efficiency nonmetal corrosion-resistant heat exchange device as claimed in claim 1, characterized in that: each cold fluid channel is an L shape, and a long side of the cold fluid channel is parallel to the length direction of the heat exchange sheet; each hot fluid channel is an inverted L shape; the inlet port of the cold fluid channel and the inlet port of the hot fluid channel are opposite to each other along the length direction of the heat exchange sheets; the outlet port of the cold fluid channel and the outlet port of the hot fluid channel are respectively located on two end portions of the same sides of the heat exchange sheets or located on two end portions of two sides of the heat exchange sheets; there forms a rectangular outcut, which is corresponding to an upright column of a heat exchanger, on a middle of one side of the heat exchange sheet to separate the hot and cold fluids; the cold and hot fluids can achieve countercurrent heat transfer.

13. The high efficiency nonmetal corrosion-resistant heat exchange device as claimed in claim 1, characterized in that: each cold fluid channel is a "2" shape; a long side of the cold fluid channel is parallel to a length direction of the heat exchange sheet; each hot fluid channel is an inverted "2" shape; the inlet port of the cold fluid channel and the outlet port of the hot fluid channel are located two different end portions of the same sides of the heat exchange sheets and the cold and hot fluids achieve countercurrent heat transfer; or the inlet port and the outlet port of the cold fluid channel are disposed along a width direction of the heat exchange sheet, and the cold and hot fluids achieve countercurrent heat transfer.

14. The high efficiency nonmetal corrosion-resistant heat exchange device as claimed in claim 1, characterized in that: the cold fluid channel is a "Z" shape; a long side of the cold fluid channel is parallel to a length direction of the heat exchange sheet; the hot fluid channel is an inverted "Z" shape; the inlet port of the cold fluid channel and the outlet port of the hot fluid channel are disposed two end portions of two sides of the heat exchange sheets; and the cold and hot fluids achieve countercurrent heat transfer.

15. A plate-type heat exchanger with a high efficiency nonmetal corrosion-resistant heat exchange device, comprising a frame and the high efficiency nonmetal corrosion-resistant heat exchange device mounted in the frame and claimed in claim 1, wherein the frame includes an upper cover, a bottom plate and an upright column, and the high efficiency nonmetal corrosion-resistant heat exchange device is mounted between the upper cover and the bottom plate of the frame.

16. The plate-type heat exchanger with a high efficiency nonmetal corrosion-resistant heat exchange device as claimed in claim 15, characterized in that: an internal surface of the frame is anti -corrosion treated by PFA coating, enamel, or lined PTFE.

* * * * *